United States Patent [19]

DeWitt et al.

[11] Patent Number: 4,606,147

[45] Date of Patent: Aug. 19, 1986

[54] SEALING JAMB LINER FOR DOUBLE-HUNG WINDOW SASH

[75] Inventors: Vern T. DeWitt; Garry P. Haltof, both of Rochester, N.Y.

[73] Assignee: Caldwell Manufacturing Company, Rochester, N.Y.

[21] Appl. No.: 622,103

[22] Filed: Jun. 19, 1984

[51] Int. Cl.[4] ..... E05D 15/16

[52] U.S. Cl. ..... 49/434; 49/435

[58] Field of Search ..... 49/428, 430, 431, 432, 49/434, 435

[56] References Cited

U.S. PATENT DOCUMENTS

| | | | |
|---|---|---|---|
| 2,122,366 | 6/1938 | Dennis | 20/69 |
| 2,273,279 | 2/1942 | Macklanburg | 49/434 |
| 2,744,297 | 5/1956 | Baker et al. | 20/52.2 |
| 2,917,788 | 12/1959 | Kunkel | 49/434 |
| 3,269,074 | 8/1966 | Darmstadt | 49/431 X |
| 3,499,248 | 3/1970 | Baer | 49/430 |
| 3,633,317 | 1/1972 | Koebel | 49/430 |
| 4,373,295 | 2/1983 | Starck | 49/432 X |

*Primary Examiner*—Kenneth Downey

*Attorney, Agent, or Firm*—Stonebraker, Shepard & Stephens

[57] ABSTRACT

A sealing jamb liner 10 for double-hung window sash includes a thick and rigid resin extrusion 24 having a pair of sash runs 11 and 12 separated by a parting bead 13. A pair of extruded flange elements 25 formed of a thin, resilient, and low spring rate resin material are mounted along respective outer sash run edges 21 and 22 opposite parting bead 13. Each flange element 25 has a sealing 27 angled obliquely of the adjacent sash run and disposed for resiliently engaging and sealing between a sash and an adjacent trim stop.

18 Claims, 5 Drawing Figures

SEALING JAMB LINER FOR DOUBLE-HUNG WINDOW SASH

BACKGROUND

Weatherproof seals for jamb liners for double-hung window sash remain unsatisfactory in spite of the many variations that have been tried. A suitable seal must fit well against the sash, seal against the trim stop, accommodate manufacturing tolerances in both the seal and the sash, and yet not unduly increase the effort necessary to raise and lower the sash. The seal must also be wind resistant and tolerant of temperature extremes. Finally, cost is very important in the highly competitive window business, and a suitable seal must do its job without hardly adding to the expense.

We have devised a solution that meets all these requirements. Our extruded resin jamb liner not only has suitable flexible flange seals, but also can be formed at nearly the same price as conventional jamb liners with ineffective seals. Our invention thus offers added sealing advantages at a competitive price.

SUMMARY OF THE INVENTION

After many failures at devising flexible flange seals for extruded resin jamb liners, we discovered that separate flange elements with sealing fins can be extruded of resilient and low spring rate resin material that is then interconnected with the outer sash run edges of a substantially rigid resin extrusion having the conventional pair of sash runs separated by a parting bead. The sealing flange elements and the sash run extrusion can be united automatically at full extrusion speed. Sealing fins on the flange elements are disposed obliquely between a sash run and the adjacent trim stop, which they engage and seal against. They span a wide enough space so as to be resiliently compressed between the trim stop and a sash to seal against and bias the sash against the parting bead. Even though the flexible resin material costs more, very little of it is used, and no after-assembly is necessary. Limiting the resilient resin to the sealing flanges also preserves the desirable characteristics and economies of the rigid resin extrusion forming the sash runs and the parting bead.

DRAWINGS

FIG. 1 is an end elevatonal view of a preferred embodiment of our jamb liner with flange seals;

FIG. 2 is an enlarged end elevational view of the right flange edge of the jamb liner of FIG. 1; and FIG. 3 is an enlarged and elevational view of the proximal end of the right flange element before insertion into a mechanical interlock with the right flange edge of the jamb liner of FIG. 2; and FIGS. 4 and 5 are end elevational views of alternative configurations of sealing flange elements usable in our invention.

DETAILED DESCRIPTION

Figure 1:
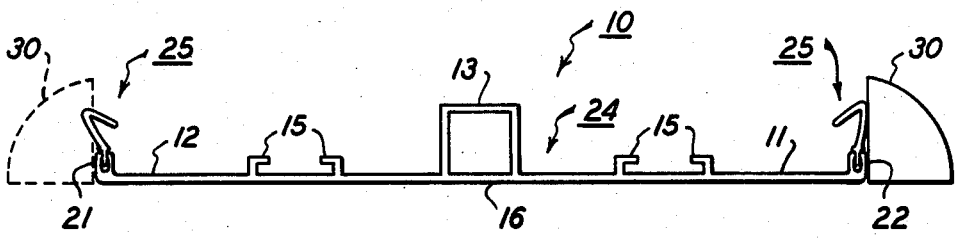

Jamb liner 10 includes a pair of sash runs 11 and 12 separated by a parting bead 13. A pair of opposed projections 15 in each of the sash runs are L-shaped in cross section and disposed to confront each other. Spring covers can be mounted in the interlock formed by projections 15, and a friction shoe traveling with each sash can run in the track between projections 15.

A resin web 16 preferably extends between sash runs 11 and 12 in the region of parting bead 13 to interconnect the planes of the sash runs and brace their outer edges 21 and 22. Web 16 helps resist any squeezing force from trim stops 30 installed so tightly that they urge sash runs 11 and 12 together under parting bead 13. Web 16 also strengthens jamb liner 10 against twisting, making it easier to install.

Except for the configuration of outer sash run edges 21 and 22 and web 16 interconnecting sash runs 11 and 12, jamb liner 10 is formed as a generally known base extrusion 24 of substantially rigid resin material, preferably polyvinyl chloride. Resilient flange seals 25 arranged at outer sash run edges 21 and 22 are formed differently, however, as explained below.

Flange seals 25, also extruded of resin material, are formed of a substantially resilient resin, such as polypropylene, having a substantially lower spring rate than the rigid resin of base extrusion 24. This allows flange elements 25 to be flexed or sprung from their home positions in response to light force and to resiliently spring back to their home positions after a flexing force is removed.

Each flange elements 25 includes a support limb 26 and a sealing fin 27, both of which are thinner in cross section than the rigid resin extrusion 24. For example, support limb 26 and sealing fin 27 are preferably less than 0.5 mm thick, compared with the more than 1.0 mm thickness that is preferred for the base extrusion 24. There are several ways that sealing fins can be arranged relative to support limbs to form flange elements 25, but we prefer the configuration shown in FIGS. 1–3.

Sealing fin 27 angles obliquely inward from a distal end 36 of support limb 26 toward the adjacent sash run 11 where it is disposed for resiliently engaging a sash 40. In an unflexed state, flange element 25 preferably leans toward the adjacent trim stop 30 as shown at the left edge of FIG. 1. Then when trim stop 30 is installed against the outer sash run edge 21 of jamb liner 10, it flexes flange element 25 inward; and flange element 25, in resistance to this, engages and seals against trim stop 30. This helps prevent air from leaking between the trim stops and the jamb liner and passing behind the sash runs.

Figure 2:
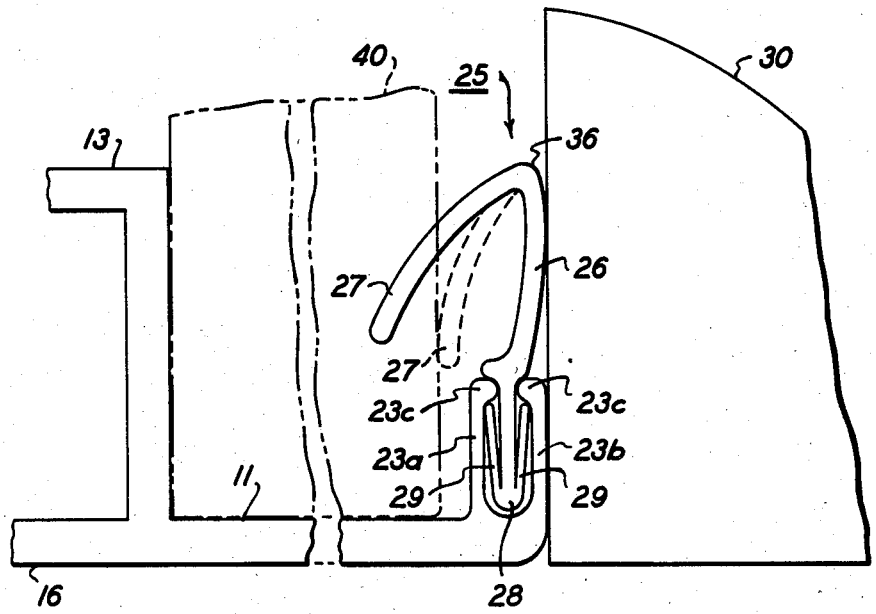

Otherwise, the oblique span of sealing fin 27 is wider than the space between trim stop 30 and sash 40 so that fin 27 is flexibly compressed between trim stop 30 and sash 40 as best shown in FIG. 2. This not only creates a seal between fin 27 engaging and pressing against the surface of sash 40, but it also presses the sash against parting bead 13. This tends to seal each sash both on the side engaged by fin 27 and on the opposite side where the sash engages parting bead 13. The scope of the biased resilient spring range of sealing fin 27 is suggested by the distance between the solid and broken line positions of sealing flange 25 in FIG. 2. This is adequate to accommodate manufacturing tolerances in the thickness of a sash and to allow fin 27 to conform to slight irregularities in a sash.

Figure 4:
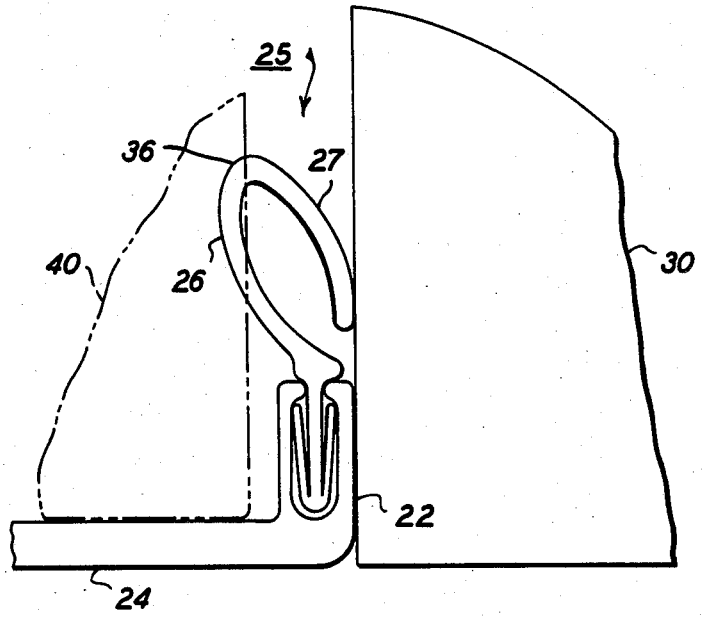

It is also possible to reverse the orientation of sealing fin 27 to engage trim stop 30, rather than sash 40, as shown in FIG. 4. A flange element 25 oriented this way engages a surface of sash 40 in the region 36 where the distal end of support limb 26 joins the proximal end of fin 27. A disadvantage with this arrangement is that the distal end of fin 27 extends outward from sash run edge 22 of base extrusion 24 where it may be damaged in shipment.

Figure 5:
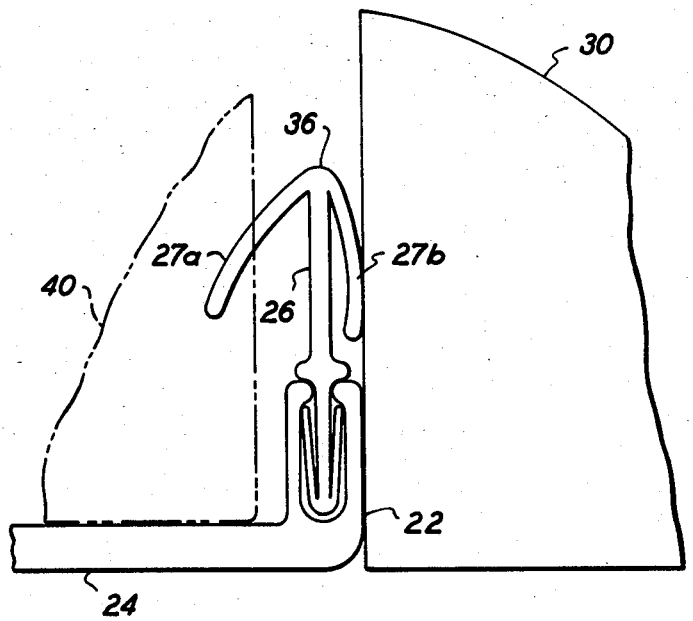

Another possibility, illustrated in FIG. 5, is an opposed pair of fins 27*a* and *b* each extending obliquely outward from the distal end 36 of support limb 26. Then one fin 27*b* can engage and seal against trim stop 30, leaving the opposite fin 27*a* disposed to engage and seal against a surface of sash 40. Such a double-finned configuration uses slightly more resilient material and leaves fin 27*b* extending beyond sash run edge 22 where it is exposed to shipment and installation damage.

Figure 3:
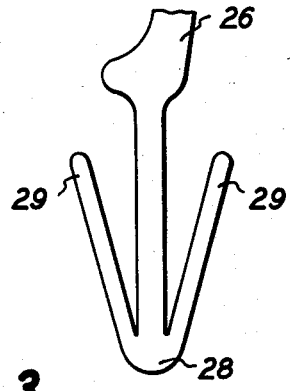

Sealing flanges 25 can be interconnected with base extrusion 24 in several ways. The differences in resin materials may inhibit a direct fusion bond, so we prefer a mechanical interlock such as shown in FIGS. 2 and 3. Other mechanical interlocks are also possible and can be combined with thermal forming accomplished as flange elements 25 are automatically joined to base extrusion 24.

Our preferred mechanical interlock, formed at the outer sash run edges 21 and 22, uses a groove between a pair of spaced-apart legs 23*a* and 23*b* having opposed projections 23*c* constricting the open end of the groove. We also form the proximal end 28 of support limb 26 with a flared pair of limbs 29 that squeeze together when proximal end 28 presses into the groove between legs 23*a* and *b*. Limbs 29, which tend to spring apart, are then trapped behind confronting lips 23*c* as shown in FIG. 2 to resist withdrawal of element 25 from base 24. Many variations on such an arrangement are possible.

Base 24 and a pair of flange elements 25 can all be extruded simultaneously and united downstream of the extruders for forming jamb liner 10 continuously. Flange elements 25 can also be preextruded and fed from a supply to join extrusion 24 shortly after it is formed. It may even be possible to feed preextruded flange elements 25 through the extrusion head that forms extrusion 24, directly united with flange elements 25. Automatically joining flange elements 25 and extrusion 24 at extrusion speed eliminates post-assembly of separate components and forms jamb liner 10 as a single end product that can serve on both sides of double-hung window sash.

We claim:

1. In a double-hung window sash jamb liner formed of a substantially rigid resin jamb liner extrusion having a pair of sash runs separated by a parting bead and extending to outer sash run edges respectively adjacent a pair of trim stops, the improvement comprising:

a. flange elements interconnected with said outer sash run edges of said jamb liner extrusion, said flange elements being formed of a resin material that is substantially more resilient and has a substantially lower spring rate than said jamb liner extrusion; and b. said flange elements each having a sealing fin disposed for resiliently engaging and sealing against said adjacent trim stop and for extending obliquely across a space wider than the distance between said adjacent trim stop and a sash in said sash run so that a sash engaging portion of said sealing fin is resiliently compressed for sealing between said adjacent trim stop and said sash and for biasing said sash against said parting bead.

2. The improvement of claim 1 wherein the thickness of said rigid resin extrusion is more than 1.0 mm, and the thickness of said sealing fin is less than 0.5 mm.

3. The improvement of claim 1 wherein said jamb liner extrusion has a groove in each of said outer sash run edges, and said flange elements are mechanically interlocked with said grooves.

4. The improvement of claim 1 wherein said jamb liner extrusion includes a bracing wall extending between said sash runs in the plane of said sash runs in the region of said parting bead.

5. The improvement of claim 4 wherein said jamb liner extrusion has a groove in each of said outer sash run edges, and said flange elements are mechanically interlocked with said grooves.

6. The improvement of claim 5 wherein the thickness of said rigid resin extrusion is more than 1.0 mm, and the thickness of said sealing fins is less than 0.5 mm.

7. A sealing system for an extruded resin jamb liner having a pair of sash runs separated by a parting bead and located between a pair of trim stops for receiving double-hung window sash, said sealing system comprising:

a. a pair of sealing flange elements formed of a resin material that is substantially more resilient and has a substantially lower spring rate than said jamb liner extrusion, said flange elements being interconnected with outer sash run edges of said jamb liner adjacent said trim stops; and b. said sealing flange elements having sealing fins disposed for resiliently engaging and sealing against said adjacent trim stops and for extending obliquely across a space wider than the distance between said adjacent trim stops and sash in said sash runs so that sash engaging portions of said sealing fins are resiliently compressed for sealing between said adjacent trim stops and said sash and for biasing said sash against said parting bead.

8. The sealing system of claim 7 wherein said sealing fins are less than 0.5 mm thick.

9. The sealing system of claim 7 wherein said flange elements each have a mechanical interlock for mounting in a groove in an outer sash run edge of said jamb liner.

10. The sealing system of claim 7 wherein said jamb liner has a bracing wall extending between said sash runs in the plane of said sash runs in the region of said parting bead.

11. The sealing system of claim 10 wherein each of said outer sash run edges of said jamb liner has a groove receiving one of said flange elements in a mechanical interlock.

12. The sealing system of claim 11 wherein said sealing fins are less than 0.5 mm thick.

13. A sealing flange mountable on an outer sash run edge of an extruded resin jamb liner for double-hung window sash, said sealing flange comprising:

a. a connector shaped for interconnecting said sealing flange with a slot in said outer sash run edge of said jamb liner;

b. a sealing fin extending resiliently away from said connector, said sealing fin being formed of a resin material that is substantially more resilient and has a substantially lower spring rate than said jamb liner; and c. said sealing fin being disposed for resiliently engaging a trim stop adjacent said outer sash run edge and for extending obliquely across a space wider than the distance between said trim stop and a sash so that a portion of said seaing fin is resiliently compressed between said trim stop and said sash.

14. The sealing flange of claim 13 wherein said sealing fin is less than 0.5 mm thick.

15. A method of sealing against air flow on either side of an extruded resin jamb liner for double-hung window sash, said jamb liner having outer sash run edges adjacent trim stops and having sash running in said sash runs of said jamb liner, said method comprising:

a. forming sealing flanges of a resin material that is substantially more resilient and has a substantially lower spring rate than said jamb liner;

b. connecting said sealing flanges with slots in said outer sash run edges of said jamb liner; and c. disposing said sealing flanges for resiliently engaging and sealing against said trim stops adjacent said outer sash run edges and for extending obliquely across a space between said trim stops and sash adjacent said trim stops so as to resiliently engage and seal against said adjacent sash.

16. The method of claim 15 including forming said sealing flange with a thickness of less than 0.5 mm.

17. The method of claim 15 including forming said jamb liner with a bracing wall extending between sash runs of said jamb liner in the plane of said sash runs in the region of a parting bead between said sash runs.

18. The method of claim 15 including using said resilient sealing flanges for biasing said sash against a parting bead between said sash runs.

* * * * *